US010780479B2

(12) United States Patent
Schulte-Vorwick

(10) Patent No.: US 10,780,479 B2
(45) Date of Patent: Sep. 22, 2020

(54) METHOD FOR STRAIGHTENING A DISTORTION OF A COMPONENT BY WAY OF A STRAIGHTENING DEVICE, AND STRAIGHTENING DEVICE

(71) Applicant: Bayerische Motoren Werke Aktiengesellschaft, Munich (DE)

(72) Inventor: Lucas Schulte-Vorwick, Landshut (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 264 days.

(21) Appl. No.: 15/890,775

(22) Filed: Feb. 7, 2018

(65) Prior Publication Data

US 2018/0161840 A1 Jun. 14, 2018

Related U.S. Application Data

(63) Continuation of application No. PCT/EP2016/071437, filed on Sep. 12, 2016.

(30) Foreign Application Priority Data

Sep. 28, 2015 (DE) ..... 10 2015 218 599

(51) Int. Cl.
*B21D 1/06* (2006.01)
*B21D 3/10* (2006.01)
(Continued)

(52) U.S. Cl.
CPC ..... *B21D 1/06* (2013.01); *B21D 1/00* (2013.01); *B21D 3/10* (2013.01); *B21D 25/00* (2013.01); *B21D 25/04* (2013.01)

(58) Field of Classification Search
CPC ... B21D 1/00; B21D 1/06; B21D 3/00; B21D 3/10; B21D 3/14; B21D 25/00;
(Continued)

(56) References Cited

U.S. PATENT DOCUMENTS 6,505,494 B1 * 1/2003 Wollermann ..... B21O 51/00 702/104
2004/0069035 A1 4/2004 Bourgon et al.
(Continued)

FOREIGN PATENT DOCUMENTS

CN 101195135 A 6/2008
CN 101332478 A 12/2008
(Continued)

OTHER PUBLICATIONS

Machine Translation of CN-100542705-C, Dai et al., Publication Year 2009, Total pp. 7 (Year: 2019).*
(Continued)

*Primary Examiner* — Teresa M Ekiert
*Assistant Examiner* — Sarkis A Aktavoukian
(74) *Attorney, Agent, or Firm* — Crowell & Moring LLP

(57) ABSTRACT

A method for straightening a distortion of a component by way of a straightening device is provided. The straightening device includes a clamping element for clamping in the component, a straightening element for introducing a straightening force into the component, and an anvil element for supporting the component during the introduction of the straightening force. Furthermore, a straightening device for straightening a distortion of a component is provided. The straightening device includes a clamping element for clamping in the component, a straightening element for introducing a straightening force into the component, an anvil element for supporting the component during the introduction of the straightening force, and a control element for operating the straightening device.

16 Claims, 3 Drawing Sheets

(51) Int. Cl.
*B21D 1/00* (2006.01)
*B21D 25/00* (2006.01)
*B21D 25/04* (2006.01)

(58) Field of Classification Search
CPC ..... B21D 25/04; B21D 37/10; B21D 37/00; B21C 51/00
See application file for complete search history.

(56) References Cited

U.S. PATENT DOCUMENTS

| | | | | |
|---|---|---|---|---|
| 2004/0149001 | A1* | 8/2004 | Stupecky | B21D 37/10 72/416 |
| 2013/0256275 | A1* | 10/2013 | Watanabe | B21C 37/0826 219/61 |
| 2014/0208817 | A1 | 7/2014 | Dai et al. | |
| 2014/0250964 | A1 | 9/2014 | Dai et al. | |

FOREIGN PATENT DOCUMENTS

| | | | | |
|---|---|---|---|---|
| CN | 100542705 | C | * | 9/2009 |
| CN | 202155396 | U | | 3/2012 |
| CN | 103962418 | A | | 8/2014 |
| CN | 104028944 | A | | 9/2014 |
| DE | 43 18 425 | C1 | | 10/1994 |
| DE | 4318425 | C1 | * | 10/1994 ..... B21D 53/886 |
| DE | 196 11 897 | A1 | | 10/1997 |
| DE | 199 20 003 | A1 | | 11/2000 |
| DE | 10 2005 022 052 | A1 | | 11/2006 |
| DE | 10 2007 002 320 | A1 | | 9/2008 |
| JP | 7-60353 | A | | 3/1995 |

OTHER PUBLICATIONS

Chinese-language Office Action issued in counterpart Chinese Application No. 201680043842.2 dated Oct. 19, 2018 with English translation (19 pages).
International Search Report (PCT/ISA/210) issued in PCT Application No. PCT/EP2016/071437 dated Dec. 21, 2016 with English translation (six pages).
German-language Written Opinion (PCT/ISA/237) issued in PCT Application No. PCT/EP2016/071437 dated Dec. 21, 2016 (five pages).
German-language Search Report issued in counterpart German Application No. 10 2015 218 599.0 dated Jun. 8, 2016 with partial English translation (12 pages).
Chinese-language Office Action issued in counterpart Chinese Application No. 201680043842.2 dated Jun. 25, 2019 with English translation (18 pages).

* cited by examiner

METHOD FOR STRAIGHTENING A DISTORTION OF A COMPONENT BY WAY OF A STRAIGHTENING DEVICE, AND STRAIGHTENING DEVICE

CROSS REFERENCE TO RELATED APPLICATIONS

This application is a continuation of PCT International Application No. PCT/EP2016/071437, filed Sep. 12, 2016, which claims priority under 35 U.S.C. § 119 from German Patent Application No. 10 2015 218 599.0, filed Sep. 28, 2015, the entire disclosures of which are herein expressly incorporated by reference.

BACKGROUND AND SUMMARY OF THE INVENTION

The present invention relates to a method for straightening a distortion of a component by way of a straightening device. The straightening device includes a clamping element for clamping the component, a straightening element for introducing a straightening force into the component, and an anvil element for supporting the component in the introduction of the straightening force. The invention furthermore relates to a straightening device for straightening a distortion of a component. The straightening device includes a clamping element for clamping the component, a straightening element for introducing a straightening force into the component, an anvil element for supporting the component in the introduction of the straightening force, and a control element for operating the straightening device.

In modern engineering, it is known for components to be produced in high volumes for mass production. A production method of this type herein can be a casting method, for example. In particular in the construction of body and vehicle structures, for example, components are increasingly produced by using a light-metal die-casting method. Apart from the mechanical properties of the component herein, above all an adherence to geometrical shape specifications is a decisive quality criterion which has to be guaranteed to be reproducible. However, the most varied factors during the production process can influence the shape of the component, in particular of a casting, and lead to a major deviation in the shape of the component in relation to a shape specification and thus to an impermissible distortion. Of course, by adapting the process management and the tools used herein, it is attempted to compensate for a distortion of this type or to at least minimize the latter. However, if a distortion of this type cannot be prevented even by these measures or be at least reduced to a tolerable deviation from a shape specification, or if the stochastic scatter of the shape of the components produced is excessive, it is known for the components to be subjected to a straightening process.

A straightening process of this type is often performed on straightening machines which in most instances have been developed individually and specifically for each individual component to be straightened, and in particular often also for a special distortion of this component. It is known herein for both measuring points as well as straightening points to be defined in advance, wherein these measuring points and straightening points in most instances are not variable in the ongoing production process. The components herein in a straightening process of this type are usually plastically deformed, for example by a straightening ram. It is known herein for experience values of preceding straightening procedures to be resorted to in order for a path-controlled stroke of the straightening ram to be determined. To this end, all relevant data are collected by a self-teaching software, in order for the experience values required to be collated. Herein, depending on a magnitude of the measured distortion, an optimal magnitude of a straightening stroke can be searched by the self-teaching software in a database, for example, and said magnitude of a straightening stroke can subsequently be carried out. Each of these straightening procedures is followed by a further complex measurement of the geometry of the component in order for the self-teaching software to be supplied with experience values and data. For this measurement, the component is removed from the straightening machine or is at least released from the clamping that is required for the straightening procedure, on account of which an additional effort in terms of time and costs is needed. If a distortion which is still outside a permissible tolerance is established herein, a further straightening procedure is performed. If the chosen straightening stroke has achieved the desired effect, this setting is stored in the database as an experience value for future straightening procedures.

These straightening methods that are known according to the prior art herein have a plurality of disadvantages. On account of the straightening machines that have been developed specially for each individual component to be straightened, a reduced flexibility in carrying out straightening procedures results. The reason for this is often that the straightening machines are fixedly established in terms of a mounting of the components and of a positioning of straightening rams and counter holders. On account thereof, adapting to different components or even only to distortions that are differently disposed in a component is, if at all, only possible with great difficulty. Moreover, the self-teaching software used as a basis requires a database with experience values that has to be filled by a multiplicity of straightening procedures that have been carried out. This filling of the database herein is particularly time-consuming and solely on account thereof causes high costs.

Also, a self-teaching software of this type can only be applied with known distortions that have already arisen in components. A newly arising distortion which, for example, by way of the disposal thereof on the component, the type thereof, and/or the magnitude thereof differs from preceding distortions requires the database to be refilled, entailing all the disadvantages that are associated therewith. Finally, as has already been described above, measuring which has to be carried out after each straightening procedure and for which the component has to be removed from the straightening machine, or at least has to be released for the clamping that is required for the straightening procedure, has a negative effect on a cycle time.

It is therefore an object of the present invention to at least in part alleviate the disadvantages described above. In particular, it is an object of the present invention to provide a method for straightening a distortion of a component by way of a straightening device, and a straightening device for straightening a distortion of a component. The method and device enable a particularly simple and cost effective implementation of a straightening procedure on a component, wherein a high flexibility in terms of any distortion scenario and low cycle times arising in the implementation of the straightening procedure can be achieved in particular.

This and other objects are achieved by a method for straightening a distortion of a component by way of a straightening device in accordance with embodiments of the present invention. Features and details which are described in the context of the method according to the invention herein of course apply also in the context of the straightening device according to the invention, and in each case vice versa, such that in terms of the disclosure pertaining to the individual aspects of the invention reference is or can be made in a reciprocating manner at all times, respectively.

According to a first aspect of the invention, the object is achieved by a method for straightening a distortion of a component by way of a straightening device, which includes a clamping element for clamping the component, a straightening element for introducing a straightening force into the component, and an anvil element for supporting the component in the introduction of the straightening force. A method according to this embodiment is characterized by the following acts:

a) ascertaining the distortion of the component as a deviation of a shape of the component from a shape specification;
b) determining a straightening scenario based at least on a result of the ascertainment carried out in act a), wherein the straightening scenario includes at least one straightening step in which the straightening force is introduced into the component;
c) disposing the component in the straightening device according to the straightening scenario determined in act b);
d) carrying out the at least one straightening step; and
e) ascertaining a straightening result of the straightening step carried out in act d), wherein the component during the ascertainment remains disposed in the straightening device.

Straightening of a distortion of a component can be carried out by a method according to an embodiment of the invention. The component herein can be a casting, for example, preferably from a metallic material. Straightening a distortion of the component herein includes in particular removal of the distortion from the component such that the component upon the implementation of the method corresponds to a shape specification or at least substantially corresponds to said shape specification, that is to say within a tolerance limit. A method according to an embodiment of the invention herein is carried out with the aid of a straightening device. A straightening device that can be used for a method according to the embodiment of the invention herein has at least one clamping element for clamping the component. It can be enabled on account thereof that the component is disposed in the straightening device in a secure and positionally fixed manner. The straightening device furthermore includes a straightening element for introducing a straightening force into the component, and an anvil element for supporting the component in the introduction of the straightening force. The straightening device can in each case also have more than one straightening element, or more than one anvil element, respectively. On account thereof, it is possible for the component to be deformed, in particular plastically deformed, by the straightening element in the straightening device, and for the distortion to be removed from the component on account thereof.

In a first act a) of the method according to the invention herein, a distortion of the component is ascertained as a deviation of a shape of the component from a shape specification. The shape of the component, that is to say the currently present geometrical design embodiment of the component, herein can be ascertained for example by measuring the component. By comparing the shape of the component with a shape specification, a deviation of the currently prevailing shape of the component from said shape specification can be ascertained. This corresponds to the ascertainment of the distortion according to the embodiment of the invention. Herein, the shape of the component of only a portion of the component can also be compared with a shape specification. Upon the implementation of act a) of the method according to the embodiment of the invention, an item of information as to how the distortion of the component is configured and furthermore at which position of the component the distortion is located is thus available. These items of information can be used in the next act b) of the method according to the embodiment of the invention, in order for a straightening scenario to be determined. Of course, all further results of the ascertainment carried out in act a) can also be used for this determination of the straightening scenario. Herein, the straightening scenario is determined so as to be adapted to the distortion identified in act a), for example by a corresponding setting or actuation, respectively, of the elements of the straightening device. A position of the clamping element and/or of the straightening element and/or of the anvil element in the straightening device can thus be adapted to the distortion identified in act a), for example. In particular, a determination of the straightening scenario can also include a suitable adaptation of the straightening step which includes the straightening scenario. A straightening step of this type of the straightening scenario herein can particularly preferably include a ram-type movement of the straightening element for plastically deforming the component in a targeted manner, for example. A ram-type movement of the straightening element of this type herein can be characterized by a magnitude of the movement carried out herein and/or by a magnitude of the straightening force generated on account thereof, for example. The straightening force that is introduced by the straightening element into the component herein is transmitted in the component and is dissipated to the straightening device again by way of the anvil element which is configured for supporting the component in the introduction of the straightening force. Upon the determination of the straightening scenario, which can in particular also include a corresponding preparation of the straightening device, in a next act c) of the method according to the embodiment of the invention the component is disposed in the straightening device. The component herein can in particular be disposed in the straightening device according to the straightening scenario determined in act b). The disposal herein in particular includes also a corresponding orientation of the component, for example, which can be adapted to the location, the type, and/or the manifestation of the distortion of the component, for example. In a disposal of the component in the straightening device, it can furthermore be considered how the individual elements of the straightening device, in particular the clamping element, the straightening element, and the anvil element, are disposed or positioned in the straightening device, respectively. A clamping of the component by the clamping element of the straightening device can also be considered to be part of the disposal of the component in the straightening device. Subsequently, the at least one straightening step is carried out in act d) of the method according to the embodiment of the invention. In this implementation of the straightening step, in particular plastic deformation of the component arises on account of the straightening force that is introduced into the component by the straightening element. A removal or at least a reduction of the distortion can be achieved on account thereof. The shape of the component can thus be approximated to the shape specification by removing or at least reducing the distortion. In a final act e) of the method according to the embodiment of the invention, it is subsequently provided for a straightening result of the straightening step carried out in act d) to be ascertained. In a manner essential to the embodiment of the invention, it is provided herein that the component during the ascertainment of the straightening result remains disposed in the straightening device. A straightening result of this type can in particular include an item of information pertaining to how successfully the distortion has been removed from the component or at least has been reduced in magnitude. According to a method, this can be provided in particular in such a manner that the component for this ascertainment of the straightening result does not need to be removed from the straightening device. The straightening device herein can in particular have the sensors required therefor, for example. A time requirement for the removal of a distortion of a component can be significantly reduced purely by the component remaining in the straightening device during the ascertainment of the straightening result. This automatically leads to a cost reduction in the production of the component. Furthermore, by way of a method according to the embodiment of the invention, a higher degree of flexibility in the straightening of distortions of components can be provided, since a dedicated straightening scenario is present, or can be determined, respectively, for each type of distortion. In particular, no learning phase is required in order to generate a database with experience values in the straightening of a specific distortion when a method according to the embodiment of the invention is carried out. Also on account thereof, by way of a method according to the embodiment of the invention, a reduction in terms of time and cost can be achieved in relation to the method for straightening a distortion of a component that is known from the prior art.

In the case of the method according to the embodiment of the invention, it can furthermore be provided that the straightening result that is ascertained in act e) is evaluated. When a residual distortion of the component is established in the evaluation of the straightening result, acts d) and e) are carried out again by way of a straightening step that is adapted to the residual distortion and that otherwise the component is removed from the straightening device. In this way, an iterative implementation of the straightening of the distortion can be achieved, on account of which, even in the case of an incomplete removal of the distortion from the component in a first straightening step, an actual removal of the distortion from the component can be ensured by the repeated and renewed implementation of acts d) and e). It can in particular also be provided herein that, if necessary, acts d) and e) are run multiple times. In the case of a method according to an embodiment of the invention, it is provided in particular that in act e), the straightening result is ascertained in such a manner that the component during the ascertainment remains in the straightening device. On account thereof, the component upon implementation of act e) of the method according to the embodiment of the invention is still deposed in the straightening device. Act d) of the method according to the embodiment of the invention and thus a renewed straightening step can thus be carried out immediately since a renewed disposal of the component in the straightening device is not necessary. A straightening step that is adapted to the residual distortion herein means in particular that straightening steps that have been previously carried out, in particular plastic deformations of the component that have already been performed on account thereof, are considered or can be considered, respectively. In the case of a renewed implementation of act d) of the method according to the embodiment of the invention, the distortion in relation to the original distortion is thus often already reduced on account of a plastic deformation of the component that has already been performed. This can considered in the adaptation of the straightening step by way of a lower straightening force and/or of an adapted, in particular smaller, movement of the straightening element. If no residual distortion of the component is established in act e), this means that the shape of the component corresponds to the shape specification, or at least substantially corresponds to the latter. In the case of the latter, a tolerance can also be considered in the ascertainment of the residual distortion, slight deviations of the shape of the component from the shape specification that are within said tolerance to remain unconsidered. In this case, the component can be assumed to correspond to the shape specification, on account of which the straightening of the distortion of the component can be considered to be complete. In this case, the component can be removed from the straightening device and be supplied to the further purpose thereof.

A method according to an embodiment of the invention can also be configured in the sense that the straightening scenario is established depending on parameters, wherein in particular at least one of the following parameters is used:

magnitude of the distortion;
position of the distortion;
type of the distortion;
alignment of the distortion;
temperature of the component;
material of the component; and
geometry of the component.

The straightening scenario by way of a dependency of this type of the straightening scenario on parameters can be adapted to the prevailing requirements in a particularly specific and precise manner. A magnitude of the distortion herein can be stated as an absolute magnitude, for example, and/or as a relative magnitude in relation to the magnitude of the component. By way of the position of the distortion, an item of information pertaining to at which location the distortion is to be found on the component can be provided. By way of the type of the distortion, an item of information pertaining to whether the distortion is configured so as to be substantially unidimensional, for example, or two-dimensional, for example, can be provided. An item of information pertaining to whether the distortion is configured so as to be linear or polynomial, for example, can also be assigned to the type of the distortion. A linear manifestation of the distortion herein means that in particular two portions of the component which per se at least substantially correspond to the shape specification mutually abut in a bend. By contrast, a polynomial manifestation of the distortion is a distortion which is configured as a continuous bent feature. Differentiation of these manifestations of the distortion can be determined herein by way of two-dimensional derivations of the shape of the component, for example, in particular by way of the second derivation, that is to say the curvature, of the component. A sudden change in the curvature herein can indicate a linear manifestation of the distortion, and a continuous profile of the curvature can indicate a polynomial manifestation of the distortion. An alignment of the distortion can in particular include items of information pertaining toward which surface of the component is distorted, in particular in the case of planar components. This item of information is of particular importance for the correct orientation of the component in the disposal of the component in the straightening device. The temperature and the material of the component are in particular parameters which can influence the deformation capability of the component. These parameters can be used in particular in determining the straightening force which in the straightening step is introduced into the component. Items of information pertaining to the geometrical design embodiment of the component, for example whether and at which positions the component has ribs and/or clearances, can be collated in particular in the geometry of the component as a parameter. A consideration also of these items of information is advantageous for the disposal of the component in the straightening device, on the one hand, as well as in the positioning of the individual elements of the straightening device. Overall, a particularly good removal of a distortion from the component can thus be achieved by way of a dependency of the straightening scenario on parameters, in particular each distortion or nevertheless at least for particularly many different distortions.

According to a preferred refinement of a method according to the invention, it can be furthermore provided that at least one parameter is determined by a simulation and/or by preliminary tests. It can be achieved in this way that the parameters are determined in a particularly positive and precise manner. The determination of the at least one parameter herein is performed once in the lead-up to the implementation of the method and is then available for all implementations of the method according to the embodiment of the invention. The actual removal or straightening of the distortion, respectively, for many components can be carried out in an altogether more rapid manner on account thereof.

In the case of a method according to an embodiment of the invention, it can also furthermore be provided that the straightening scenario determined in act b) includes at least one clamping position of the clamping element and/or at least one straightening position of the straightening element and/or at least one anvil position of the anvil element. A particularly flexible adaptation to the currently prevailing distortion can be performed in this way. In particular, it can be preferably provided herein that the elements, in particular the clamping element and/or the straightening element and/or the anvil element, are disposable in the straightening device in a flexible and adaptable manner. It can in particular also be considered herein that the straightening force that is required for straightening the distortion is also dependent on a straightening lever. A straightening lever of this type herein is in particular influenced by the spacing of the straightening position, that is to say the position of the straightening element, from the clamping position or from the anvil position, respectively, that is to say the positions of the clamping element or of the anvil element, respectively. A determination of the straightening scenario that is particularly tailored to requirements can also be performed on account thereof.

A method according to an embodiment of the invention can moreover be configured with a view to a ram stroke of the straightening element being established in the straightening step. The ram stroke is configured at least as a combination of a contact stroke, of a straightening stroke, and of a return stroke. It is preferable herein that the contact stroke and the straightening stroke are performed in the same direction, and the return stroke is performed in a direction that is counter to the former direction. The straightening element during the contact stroke is repositioned so far in such a manner that said straightening element just contacts the construction element. After the contact stroke, the straightening element is thus in a position which corresponds to the shape of the component prior to the introduction of the straightening force. Proceeding from this position which the straightening element assumes upon carrying out the contact stroke, the straightening stroke in which the actual introduction of the straightening force into the component is conducted is performed. The component on account of the introduction of the straightening force is thus deformed, in particular at least partially plastically deformed, during the straightening stroke. In the subsequent return stroke, the straightening element is retracted so far in such a manner that the straightening element just contacts the component. Since the component in most instances is at least partially elastic, the component in most instances follows the movement of the straightening element during the return stroke. The return stroke herein is completed when the component thus no longer follows the movement of the straightening element. After the return stroke, the straightening element is thus in a position which corresponds to the shape of the component after the introduction of the straightening force. On account of the ram stroke being subdivided as a combination of the contact stroke, the straightening stroke, and the return stroke, each of these individual strokes can be individually determined and established. On account thereof, a particularly flexible and precise overall setting of the ram stroke can be achieved.

In the case of a method according to an embodiment of the invention, it can furthermore be preferably provided that the straightening stroke includes a straightening proportion and an overpressing proportion. In particular, the straightening proportion herein is the proportion of the straightening stroke between the position which the straightening element assumes after the contact stroke, and the position of the straightening element in which the component by the straightening element is deformed in such a manner that the shape of the component corresponds to the shape specification. The deformation of the component that has been carried out up to this point thus corresponds to the permanent plastic deformation of the component pursued. Since the component to be straightened can often react to deformations in an at least partially elastic manner, the straightening proportion is followed by an overpressing proportion of the straightening stroke in order for this elastic restoration of the component to be overcome. The overpressing proportion herein in terms of magnitude is preferably chosen in such a manner that a plastic deformation of the component remains after the restoration of the component during the return stroke. The straightening of the distortion can be effected in particular by this plastic deformation of the component.

According to a particularly preferred refinement of a method according to the invention, it can be furthermore provided that for ascertaining the straightening result in act e), a magnitude of the straightening stroke and a magnitude of the return stroke are evaluated, in particular that a difference between the magnitude of the straightening stroke and the magnitude of the return stroke is evaluated. It can be exploited herein that the straightening stroke begins after the contact stroke which defines the original location and shape of the component. Additionally, the return stroke ends at a position which corresponds to the plastic deformation of the component that is caused by the straightening stroke. This in particular can be explained in that the return stroke ends when the straightening element still just contacts the component. The remaining plastic deformation of the component can thus be ascertained directly by an evaluation of the magnitude of the straightening stroke and of the magnitude of the return stroke in particular by forming a difference of these magnitudes. Furthermore, in particular under consideration of the shape specification, it can be ascertained on account thereof whether the distortion has already been straightened, in particular removed, by carrying out the straightening step, or whether a residual distortion remains in the component, wherein a tolerance range can also be taken into account herein. A particularly simple ascertainment of a straightening result of the straightening step carried out can thus be provided by using the magnitudes of the straightening stroke and of the return stroke, in particular by taking into account the difference of these magnitudes.

A method according to an embodiment of the invention can moreover be configured with a view to an end of the contact stroke and/or an end of the return stroke being determined by measuring a contact force between the component and the straightening element. An end of the contact stroke is reached when the straightening element just contacts the component. An end of the return stroke is reached when the straightening element still just contacts the component. This "just contact" or "still just contact," respectively, between the component and the straightening element herein can be determined in a particularly simple manner by measuring a contact force between the component and the straightening element. For measuring the contact force in this manner, the straightening device herein can have a respective force sensor, disposed in the straightening element, for example. A contact force of this type offers information pertaining to how strongly the straightening element presses against the component, or is pressed against the latter, respectively. This force is particularly minor at the beginning of any contact between the straightening element and the construction element, such as prevails at the end of the contact stroke, for example, or at the termination of a contact of this type between the straightening element and the component, such as is the case at the end of the return stroke, for example. By ascertaining a moment at which precisely this contact force is particularly minor, the point in time of an end of the contact stroke, or of an end of the return stroke, respectively, can thus be determined in a particularly simple manner. In particular, the respective end of the contact stroke, or of the return stroke, respectively, can be determined in a particularly simple and precise manner on account thereof, since a feedback pertaining to the position of the straightening element is performed directly by way of the contact with the component that is just beginning, or just ending, respectively.

In a method according to an embodiment of the invention, it can be particularly preferably provided herein that the contact force is less than approx. 100 N, preferably less than approx. 50 N. This is particularly preferred for the reason that a force of approx. 100 N, preferably of approx. 50 N, is indeed still readily measurable, on the one hand, but, on the other hand, is minor in such a manner that no deformation or at least no substantial deformation of the component is still performed on account of this force. The contact force herein can in particular not become less than 0 N since there will no longer be any contact between the component and the straightening element in this case, and the straightening element thus no longer contacts the component. By choosing the contact force that is less than approx. 100 N, preferably less than approx. 50 N, a reliable determination of the end of the contact stroke, or of the return stroke, respectively, can thus be provided, on the one hand, wherein, on the other hand, any influence on the shape of the component by way of a deformation can be avoided.

Moreover, it can be provided in the case of a method according to an embodiment of the invention that prior to act a) and/or upon removal of the component from the straightening device, a shape of the component is measured, in particular optically measured, after the distortion has been straightened. It can be achieved in this manner that the shape of the component is particularly precisely known. An ascertainment of the distortion of the component as a deviation of the measured shape of the component from a shape specification in act a) of the method according to the embodiment of the invention can be carried out in a particularly precise manner on account thereof. In particular, particularly precise measuring of the shape of the component can be achieved by using an optical measuring method, for example using a laser or a structured light projector.

A method according to the invention can furthermore preferably be refined with a view to the shape of the component when measured being ascertained as a scatter plot. A scatter plot of this type herein represents a particularly suitable data format, since the component is stored as a number of points and the positions of said points in space. On account thereof, a distortion of the component for each of the stored points of the scatter plot can be determined, for example. Scatter plots having a variable point spacing can also be used, for example. On account thereof, it can be enabled that a smaller point spacing is used in the case of large changes, that is to say in the case of large distortions, on account of which a better resolution of the respective distortion can be achieved. In the case of small changes, or of no changes, respectively, a larger point spacing can be used, on account of which a quantity of data of the scatter plot that has to be stored can be reduced. Overall, a scatter plot represents a particularly suitable data format since a shape of a component can be described in a particularly precise manner, on the one hand, and a data volume can be reduced, on the other hand.

According to a second aspect of the invention, the object is achieved by a straightening device for straightening a distortion of a component. The straightening device includes a clamping element for clamping the component, a straightening element for introducing a straightening force into the component, an anvil element for supporting the component in the introduction of the straightening force, and a control element for operating the straightening device. A straightening device according to the embodiment of the invention is characterized in that the control element is configured for carrying out a method according to the first aspect of the invention. Accordingly, a straightening device according to this embodiment of the invention offers the same advantages as have been explained in detail with reference to a method according to the invention according to the first aspect of the invention. Particularly preferably, the clamping element and/or the straightening element and/or the anvil element herein are variably positionable in the straightening device. A particularly high flexibility in terms of the components to be straightened, or of the distortions of the components to be straightened, respectively, can be provided on account thereof.

A straightening device according to an embodiment of the invention can furthermore be characterized in that the straightening element has a contact force sensor, in particular a strain gauge, preferably a Piezoelectric force sensor, for measuring a contact force between the straightening element and the component. Any contact between the straightening element and the component can be ascertained in a particularly simple manner by way of a contact force sensor of this type, since a contact force arises precisely in the case of a contact of this type between the straightening element and the component. Strain gauges and preferably piezoelectric force sensors herein are particularly suitable contact force sensors for this application. By measuring a contact force, in particular a position of the straightening element in relation to the component can be ascertained, as has been described above, in particular at the end of a contact stroke or of a return stroke, respectively, of the straightening element. An ascertainment of a straightening result can thus, for example, also be enabled by a contact force sensor of this type, wherein the component in this ascertainment of the straightening result can remain in the straightening device.

In the case of a straightening device according to an embodiment of the invention, it can moreover be provided that the straightening element and/or the anvil element have/has a multiplicity of rams, wherein the rams are disposed in the manner of a matrix, and wherein the rams are configured so as to be individually actuatable. In the context of the invention, disposed in the manner of a matrix herein can mean in particular that the individual rams are mutually disposed in rows and columns. The individual rams can preferably be disposed so as to be mutually adjacent and/or mutually contacting. In the context of the invention, "individually actuatable" can mean in particular that each of the individual rams, or at least different groups of individual rams, can be actuated independently of all other rams. Alternatively or additionally, an individual actuation in the sense of the invention can also include that all rams can be simultaneously actuated or repositioned, respectively, in particular until said rams contact the component. Particularly preferably, in this instance the individual rams can subsequently be fixed in the respective position. On account thereof, a shape of the component can be reproduced by the rams in a particularly simple manner. Overall, it can be achieved by an arrangement of rams in the manner of a matrix that specific positions of the component can be supported, or be impinged with a straightening force, respectively, by an actuation of individual rams. Supporting, or introducing the straightening force, respectively, caused by an actuation of a plurality of rams, can also be performed at a plurality of positions. A particularly flexible straightening device that is adaptable to a multiplicity of components and potential distortions can thus be achieved by way of a design embodiment of the straightening element and/or of the anvil element of this type.

Further advantages, features, and details of the invention are derived from the following description in which exemplary embodiments of the invention are described in detail with reference to the drawings. The features mentioned in the claims and in the description herein can in each case be relevant to the invention individually or in any combination.

DETAILED DESCRIPTION OF THE DRAWINGS

Figure 1:
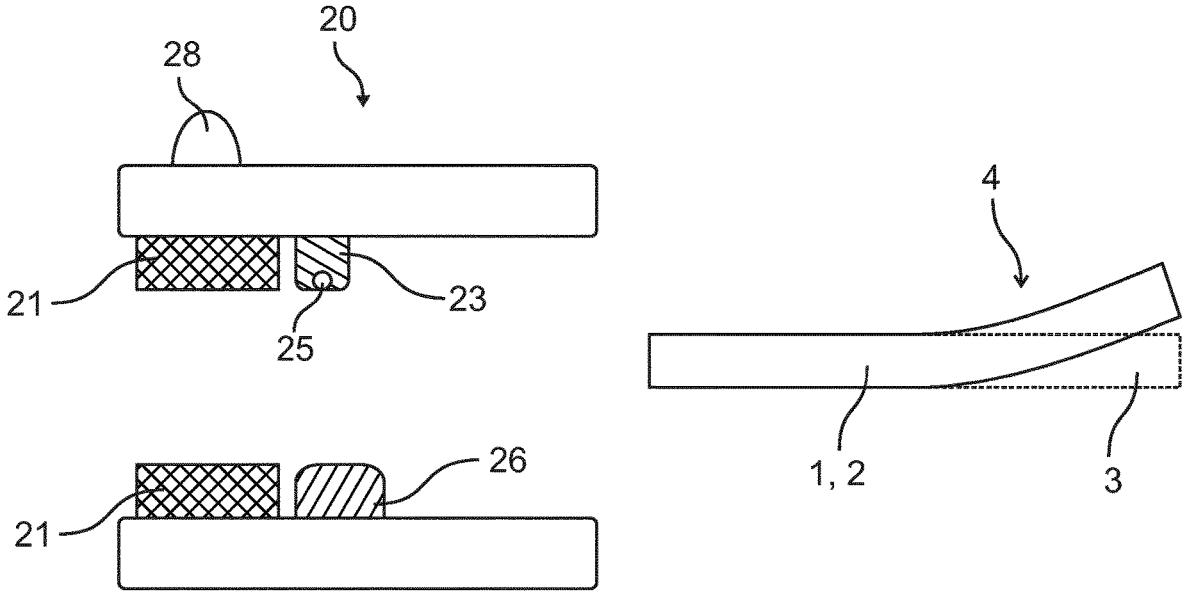
FIG. 1 is a schematic view of a straightening device according to an embodiment of the invention and a component with a distortion.

A straightening device 20 according to an embodiment of the invention is shown in FIG. 1. The straightening device 20 according to the embodiment of the invention herein has in particular a control element 28 which is configured for carrying out a method according to the embodiment. The straightening device 20 according to the embodiment furthermore has a clamping element 21 which is configured for clamping a component 1. Furthermore, a straightening element 23 and an anvil element 26 are shown as part of the straightening device 20. The straightening element 23 herein is configured for introducing a straightening force 11 (not conjointly illustrated) into the component 1, wherein the anvil element 26 is configured for supporting the component 1 in the introduction of said straightening force 11. In order to be able to establish a contact, or an end of said contact, respectively, between the straightening element 23 and the component 1, the straightening element 23 has a contact force sensor 25. A contact force sensor 25 of this type herein can be configured as a strain gauge, for example, but preferably as a piezoelectric force sensor. Apart from the illustrated straightening device 20 according to the embodiment of the invention, a component 1 is illustrated. This component 1 has a shape 2 which has a distortion 4. In order for this to be highlighted, a shape specification 3 is also conjointly illustrated by a dashed line beside the shape 2 of the component 1. The distortion 4 herein is in particular ascertained in act a) of a method according to the embodiment of the invention by way of a deviation of the shape 2 of the component 1 from the shape specification 3. Based on a result of this ascertainment which can be carried out in particular in the control element 28, a straightening scenario 10 (not conjointly illustrated) can likewise be determined in the control element 28.

Figure 2:
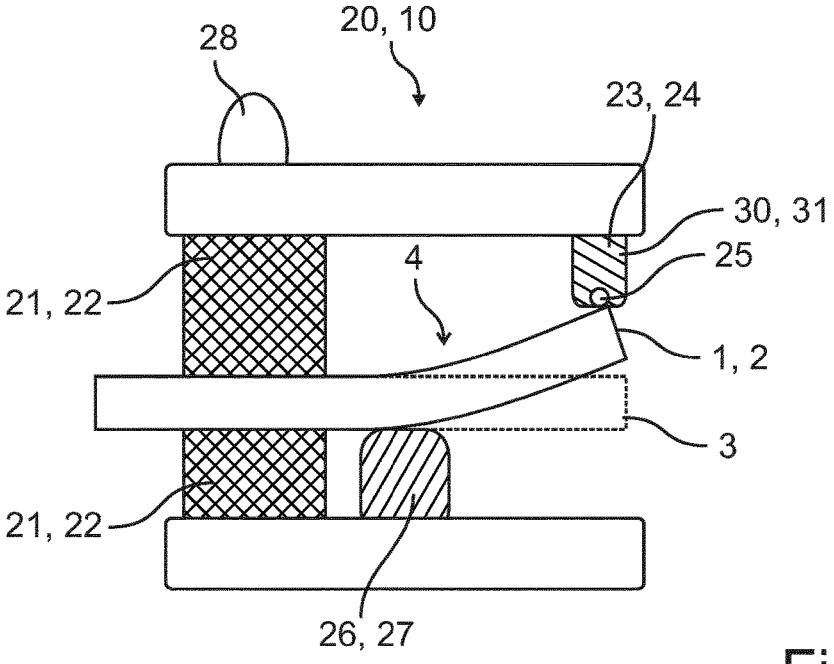
FIGS. 2-4 are schematics views of a straightening device according to an embodiment of the invention when carrying out a method according to the embodiment of the invention.
Figure 3:
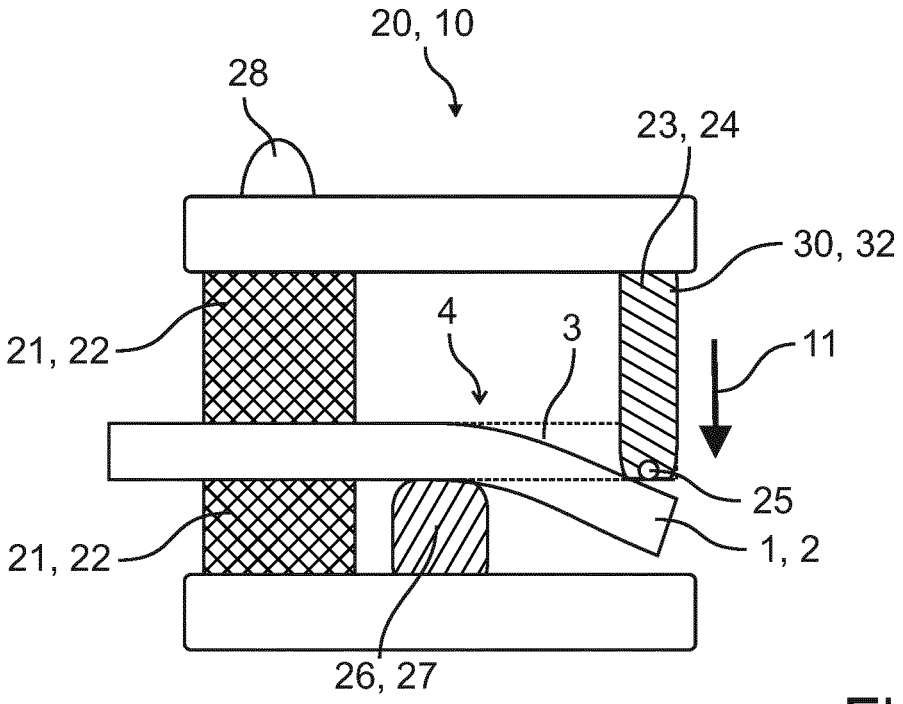
Figure 4:
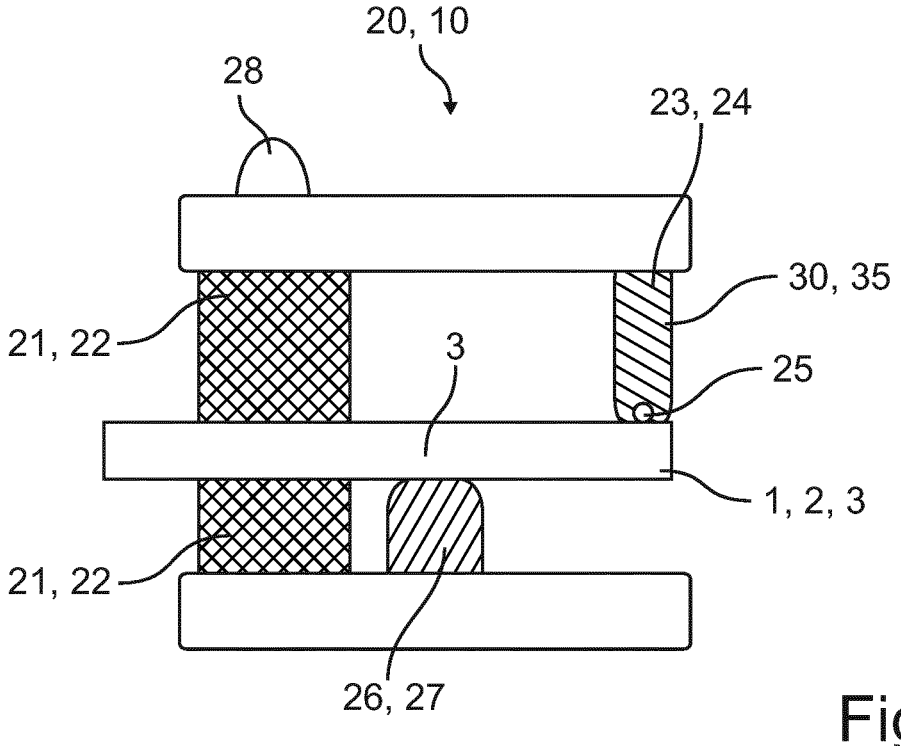

The implementation of the straightening process by way of a straightening scenario 10 is illustrated at least in portions in FIGS. 2, 3, and 4. In order for the straightening process to be carried out, the component 1 was disposed in the straightening device 20. According to the straightening scenario 10, the clamping element 21 is in the clamping position 22 thereof and fixes the component 1 in the straightening device 20. The straightening element 23 is in the straightening position 24 thereof; the anvil element 26 is in the anvil position 27 thereof. The respective positions 22, 24, 27 of the elements 21, 23, 26 herein are stored as part of the straightening scenario 10. The straightening scenario 10 herein is in particular adapted to the distortion 4 of the component 1, wherein the distortion 4 was ascertained by a comparison between the shape 2 of the component 1 and a shape specification 3. In the stage of a method according to the embodiment of the invention as illustrated in FIG. 2, the straightening process has already begun; in particular, a contact stroke 31 has already been carried out as part of the ram stroke 30 of the straightening element 23. The contact stroke 31 herein has a magnitude which is determined in that the straightening element 23 just contacts the component 1. In order for this position of the straightening element 23 to be able to be reliably established, the straightening element 23 has a contact force sensor 25. As soon as the contact force sensor 25 measures a minor contact force, this is interpreted as contact between the straightening element 23 and the component 1. The contact stroke 31 is completed at this moment. Next, a straightening stroke 32 is carried out by the straightening element 23. This is illustrated in FIG. 3. In this straightening stroke 32, a straightening force 11 is introduced into the component 1. The straightening force 11 herein is transmitted in the component 1 and dissipated into the anvil element 26. It can be clearly seen that the component 1 is deformed beyond the shape specification 3 by the straightening force 11, caused by the straightening element 23 at the end of the straightening stroke 32 thereof. In the case of an elastic restoration of the component 1, it can be in particular achieved on account thereof that a plastic deformation of the component 1 nevertheless remains, in particular preferably in such a manner that the new shape 2 of the component 1 corresponds to the shape specification 3. This is shown in particular in FIG. 4. The straightening element 23 in the return stroke 35 thereof is again retracted in a movement of which the movement direction is counter to the contact stroke 31 or to the straightening stroke 32, respectively. This is carried out in particular so far until the contact force between the straightening element 23 and the component 1 as measured by the contact force sensor 25 becomes particularly minor. Particularly minor in the context of the invention herein means in particular approx. 50 N. By way of this definition of the position of the straightening element 23 after the return stroke 35, a position, or a shape 2 of the component 1, respectively, after implementation of a straightening process, can thus also be ascertained. A removal of the component 1 from the straightening device 20 for measuring the shape 2 of the component 1, said removal also in particular being time- and labor-intensive, can be avoided on account thereof. Overall, a particularly simple, time and cost saving straightening of a distortion 4 of a component 1 can thus be provided by a straightening device 20 according to the embodiment of the invention, or a method according to the embodiment of the invention.

Figure 5:
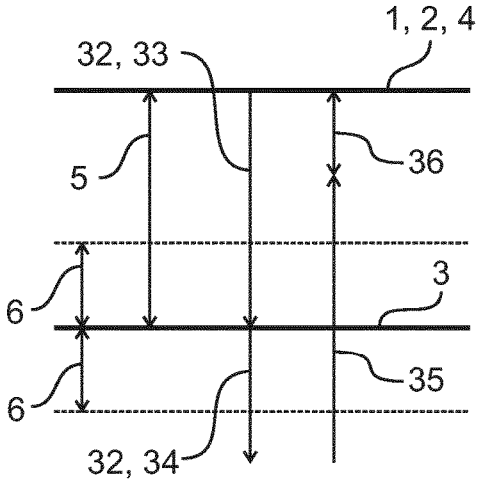
FIG. 5 is a schematic view of a first design embodiment of a straightening stroke and of a return stroke.
Figure 6:
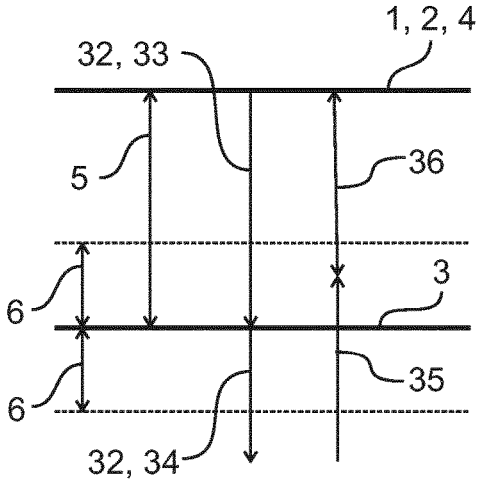
FIG. 6 is a schematic view of a further design embodiment of a straightening stroke and of a return stroke.

FIGS. 5 and 6 show in each case a straightening stroke 32 and a return stroke 35, illustrated in a schematic manner for a component 1. The component 1 herein prior to the implementation of the straightening stroke 32 is in a shape which has a distortion 4. Furthermore drawn is a shape specification 3 which is to be achieved by straightening the distortion. There is a deviation 5 which has to be overcome between the shape 2 of the component and the shape specification 3 of the component. The deviation 5 herein is considered as already having been overcome when the shape 2 of the component 1 after the implementation of the method according to the embodiment of the invention is within a tolerance 6 about the shape specification 3. It is furthermore illustrated in FIGS. 5 and 6 that the straightening stroke 32 is composed of a straightening proportion 33 and an overpressing proportion 34. Herein, the straightening proportion 33 is that proportion of the straightening stroke 32 that corresponds to the deviation 5 and thus corresponds to a deformation of the component 1 from the shape 2 of the latter having the distortion 4 up to the shape specification 3. The overpressing proportion 34 corresponds to that proportion of the straightening stroke 32 that goes beyond this straightening proportion 33. A plastic deformation of the component 1 is to be insured by this overpressing proportion 34, and an elastic restoration of the component 1 is to be equalized by said overpressing proportion 34. In the situation illustrated in FIG. 5, a return stroke 35 which represents a terminal position outside the tolerance range 6 is illustrated. The difference 36 between the beginning of the straightening stroke 32 and the end of the return stroke 35 is thus smaller than a difference between the deviation 5 and the tolerance 6. On account thereof, a further straightening stroke is required in order for a terminal position of the component 1 that is within the tolerance 6 about the shape specification 3 to be achieved after the implementation of the ram stroke 30 (not conjointly illustrated). This is shown in FIG. 6, for example. Here, the return stroke 35 already ends so close to the shape specification 3 in such a manner that the difference 36 is larger than a difference between the deviation 5 and the tolerance 6. A shape 2 of the component 1 is thus so close to the shape specification 3 that the distortion 4 can be considered as having been straightened. In a third possibility (not conjointly illustrated), the difference 36 between the beginning of the straightening stroke 32 and the end of the return stroke 35 can be larger than the sum of the deviation 5 and the tolerance 6. In this case, the component 1 has been over-straightened and now has to be re-straightened in the opposite direction. To this end, a removal of the component 1 from the straightening device 20 (not conjointly illustrated) is often required. Such an oscillating approximation to the shape specification 3 is therefore to be avoided. This can be achieved by choosing a suitable straightening scenario 10 which in particular has a straightening stroke 32 (not conjointly illustrated) that is adapted to the distortion 4 ascertained.

Figure 7:
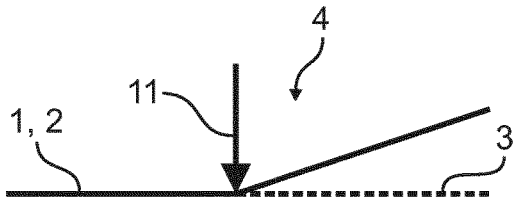
FIG. 7 is a schematic illustration of a linear distortion scenario.
Figure 8:
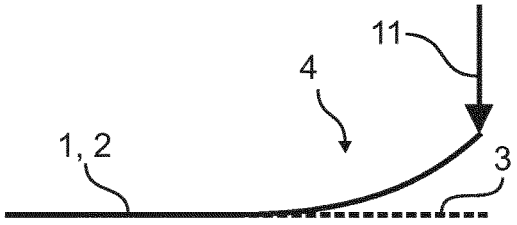
FIG. 8 is a schematic illustration of a polynomial distortion scenario.

FIGS. 7 and 8 show two potential distortion scenarios of a distortion 4. A linear distortion scenario herein is shown in FIG. 7. Said linear distortion scenario is characterized in particular in that the shape 2 of the component 1 has two regions which at least substantially correspond to the shape specification 3, but are mutually distorted by a locally delimited bend. A distortion 4 of this type is referred to as a linear distortion. A linear distortion 4 of this type herein can be established in particular in that a curvature of the shape 2 of the component 1, in particular a two-dimensional curvature which can be determined as a second derivation, changes suddenly, in particular changes abruptly, at this special point. In this case, a straightening scenario 10 (not conjointly illustrated) in which a straightening force 11 is introduced into the component 1 at this point of the sudden change in the curvature can be determined. It can be achieved on account thereof that the distorted part of the component 1 in a localized manner folds back directly at the location of the distortion 4, on account of which the shape 2 of the component 1 again corresponds to the shape specification 3, or at least substantially corresponds to the latter, respectively. A further potential distortion scenario of a distortion 4 is shown in FIG. 8. The shape 2 of the component 1 there does not change suddenly but continuously, in particular in a polynomial manner. A distortion 4 of this type is therefore also referred to as polynomial distortion 4. As opposed to a linear distortion 4 in which a curvature of the shape 2 of the component 1 changes suddenly, a sudden change of this type does not arise in the case of a polynomial distortion 4. Since the distortion 4 takes place continuously, a straightening scenario 10 (not conjointly illustrated) in which a straightening force 11 is introduced into the component 1 at the location of the maximum distortion 4 can be preferably determined in this case. It can be achieved on account thereof that at least part of the straightening force 11 acts across the entire distortion path, on account of which the entire distortion 4 can likewise be deformed in such a manner that the shape 2 of the component 1 after the implementation of the method corresponds to the shape specification 3 or at least substantially corresponds to the latter.

LIST OF REFERENCE SIGNS

1 Component
2 Shape
3 Shape specification
4 Distortion
5 Deviation
6 Tolerance
10 Straightening scenario
11 Straightening force

20 Straightening device
21 Clamping element
22 Clamping position
23 Straightening element
24 Straightening position
25 Contact force sensor
26 Anvil element
27 Anvil position
28 Control element
30 Ram stroke
31 Contact stroke
32 Straightening stroke
33 Straightening proportion
34 Overpressing proportion
35 Return stroke
36 Difference The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method for straightening a distortion of a component by way of a straightening device, the straightening device including a clamping element for clamping the component, a straightening element for introducing a straightening force into the component, and an anvil element for supporting the component in the introduction of the straightening force, the method comprising the acts of:

a) ascertaining the distortion of the component as a deviation of a shape of the component from a shape specification;

b) determining a straightening scenario based at least on a result of the ascertainment carried out in act a), wherein the straightening scenario comprises at least one straightening step;

c) disposing the component in the straightening device according to the straightening scenario determined in act b);

d) carrying out the at least one straightening step by introducing the straightening force into the component; and e) ascertaining a straightening result of the at least one straightening step carried out in act d), wherein the component during the ascertainment ascertaining of the straightening result remains disposed in the straightening device;

wherein the at least one straightening step includes a ram stroke of the straightening element:

wherein the ram stroke includes a contact stroke, a straightening stroke, and a return stroke;

wherein for ascertaining of the straightening result in act e), a difference between a magnitude of the straightening stroke and a magnitude of the return stroke is evaluated.

2. The method according to claim 1, wherein the straightening scenario is determined additionally based on at least one of the following parameters:

a magnitude of the distortion;

a position of the distortion;

a type of the distortion;

an alignment of the distortion;

a temperature of the component;

a material of the component; and a geometry of the component.

3. The method according to claim 2, wherein the at least one parameter is determined by a simulation and/or by preliminary tests.

4. The method according to claim 2, wherein the straightening scenario determined in act b) further comprises at least one clamping position of the clamping element, and/or at least one straightening position of the straightening element, and/or at least one anvil position of the anvil element.

5. The method according to claim 1, wherein the straightening scenario determined in act b) further comprises at least one clamping position of the clamping element, and/or at least one straightening position of the straightening element, and/or at least one anvil position of the anvil element.

6. The method according to claim 1, wherein the straightening stroke comprises a straightening proportion and an overpressing proportion.

7. The method according to claim 1, wherein an end of the contact stroke and/or an end of the return stroke is determined by measuring a contact force between the component and the straightening element.

8. The method according to claim 7, wherein the contact force is less than approximately 100 N.

9. The method according to claim 8, wherein the contact force is less than approximately 50 N.

10. The method according to claim 1, the method further comprising the act of: prior to act a) measuring a shape of the component.

11. The method according to claim 10, wherein the shape of the component is optically measured.

12. The method according to claim 10, wherein the shape of the component is ascertained as a scatter plot.

13. A straightening device for straightening a distortion of a component, comprising:

a clamping element for clamping the component;

a straightening element for introducing a straightening force into the component;

an anvil element for supporting the component in the introduction of the straightening force; and a control element for operating the straightening device, the control element configured to:

a) ascertain the distortion of the component as a deviation of a shape of the component from a shape specification;

b) determine a straightening scenario based at least on a result of the ascertainment carried out in act a), wherein the straightening scenario comprises at least one straightening step in which the straightening force is introduced into the component;

c) dispose the component in the straightening device according to the straightening scenario determined in act b);

d) carry out the at least one straightening step, wherein the at least one straightening step includes a ram stroke of the straightening element and wherein the ram stroke includes a contact stroke, a straightening stroke, and a return stroke; and e) ascertain a straightening result of the at least one straightening step carried out in act d), wherein the component during the ascertainment of the straightening result remains disposed in the straightening device and wherein to ascertain the straightening result, evaluate a difference between a magnitude of the straightening stroke and a magnitude of the return stroke.

14. The straightening device according to claim 13, wherein the straightening element includes a contact force sensor for measuring a contact force between the straightening element and the component.

15. The straightening device according to claim 14, wherein the contact force sensor is a Piezoelectric force sensor.

16. The straightening device according to claim 13, wherein the straightening element and/or the anvil element have/has a multiplicity of rams, the rams are disposed in the manner of a matrix, and the rams are configured so as to be individually actuatable.

* * * * *